US005301871A

United States Patent [19]

Gross et al.

[11] Patent Number: 5,301,871

[45] Date of Patent: Apr. 12, 1994

[54] PLATE AND CUP HOLDER

[75] Inventors: David F. Gross, Oak Forest; Chris A. Mercede, Blue Island; Brian S. Grant, Wood Dale, all of Ill.

[73] Assignee: Three Hands, Inc., Oak Forest, Ill.

[21] Appl. No.: 14,783

[22] Filed: Feb. 8, 1993

[51] Int. Cl.[5] ..... B65D 5/42

[52] U.S. Cl. ..... 229/1.5 H; 229/904

[58] Field of Search ..... 229/1.5 H, 164, 904, 229/120.14, 120.15, 120.16; 206/561, 564, 565; 220/737, 738

[56] References Cited

U.S. PATENT DOCUMENTS

| | | | |
|---|---|---|---|
| 2,314,935 | 3/1943 | Gutterman | 206/565 |
| 2,427,697 | 9/1947 | Weidler | 270/737 |
| 2,512,963 | 6/1950 | Peiker | 229/904 |
| 2,640,589 | 6/1953 | Foster et al. | 206/565 |
| 2,808,191 | 10/1957 | Cramer . | |
| 2,875,940 | 3/1959 | Dunn | 229/904 |
| 2,916,180 | 12/1959 | Alger . | |
| 3,094,264 | 8/1963 | Petrone . | |
| 3,201,024 | 8/1965 | Brokop | 229/904 |
| 3,401,858 | 9/1968 | White et al. . | |
| 3,730,419 | 5/1973 | Botterman et al. | 229/904 |
| 4,156,484 | 5/1979 | Wischusen | 206/565 |
| 4,732,274 | 3/1988 | Bouton | 206/561 |
| 4,981,217 | 1/1991 | Lim | 206/565 |
| 5,119,967 | 6/1992 | Ercolani | 220/737 |

*Primary Examiner*—Gary E. Elkins

*Attorney, Agent, or Firm*—Wood, Phillips, VanSanten, Hoffman & Ertel

[57] ABSTRACT

A plate and cup holder has a plurality of panels attached foldably relative to each other and convertible into an assembled state. A support panel has a first end with an opening for receiving a cup and a second end for supporting a plate. Side panels are attached to the support panel along opposite said side edges thereof and are swung transversely of the support panel when the holder is the assembled state. Each side panel has a tab which is swung inwardly of the respective side panel and beneath the first end of the support panel when the holder is in the assembled state. An end panel is attached to the support panel and is engaged with the tabs to maintain the holder in the assembled state.

22 Claims, 6 Drawing Sheets

PLATE AND CUP HOLDER

BACKGROUND OF THE INVENTION

1. Technical Field

This invention is directed to a tray for carrying a plate and a cup and for controlling the plate and cup with a single hand while food and beverages supported thereon are consumed.

2. Background of the Invention

People consume food and beverages while standing at a variety of occasions, such as picnics, food fairs, carnivals and the like. Even where seating is available at such an occasion, there may not be table facilities upon which a plate of food or a beverage cup can be placed. Carrying readily consumable food and drink from a point of purchase to an eating place is difficult. Further, it is difficult for an individual holding food and a drink to control both a plate and a cup and avoid spillage when eating.

Holders have been used to carry cups and bagged food from place-to-place. Holders also have been used to control a plate and a cup with a single hand, whereby a person carrying the holder can use her second hand to consume food or drink from the holder or, alternatively, to for carrying food and a beverage from place-to-place. This invention is directed to providing a new plate and cup holder of the character described.

SUMMARY OF THE INVENTION

An object, therefore, of the invention is to provide an improved plate and cup holder that can be grasped by a single hand of a user to facilitate transportation and consumption of food and drink supported on the holder.

In the exemplary embodiment of the invention, a plate and cup holder has a plurality of panels attached foldably relative to each other and convertible into an assembled state. A support panel has a first end with an opening for receiving a cup and a second end for supporting a plate. Side panels are attached to the support panel along opposite side edges thereof and are swung transversely of the support panel when the holder is in the assembled state. Each side panel has a tab which is swung inwardly of the respective side panel and beneath the first end of the support panel when the holder is in the assembled state. An end panel is attached to the support panel and is engaged with the tabs to maintain the holder in the assembled state.

One end of the support panel has an opening surrounded by deformable fingers for closely embracing a cup received in the opening, and a second end of the support panel has a plurality of upright tabs for constraining movement of a plate on the support panel. The opposite side edges of the support panel diverge from the one end toward the second end whereby the width of the second end of the support panel is greater than the width of the first end of the support panel. In addition, the second end of the support panel has an arcuate edge to define a support surface conforming at least in part with a circular plate supported thereon.

In the exemplary embodiment, the holder has an opening in the end panel for receiving the fingers of an individual carrying the holder. Preferably, the opening in the end panel has an edge made up of a number of adjacent notches for individually receiving the fingers of an individual grasping the holder.

Alternatively, a handle extends transversely from the end panel when the holder is in the assembled state.

In another aspect of the invention, a blank is provided which has a plurality of panels attached foldably relative to each other and which is convertible from a flattened state into a plate and cup holder of the character above described.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and advantages, may be understood from the following description taken in conjunction with the accompanying drawings, in which like reference numerals identify like elements in the figures and in which:

DETAILED DESCRIPTION OF THE INVENTION

Figure 1:
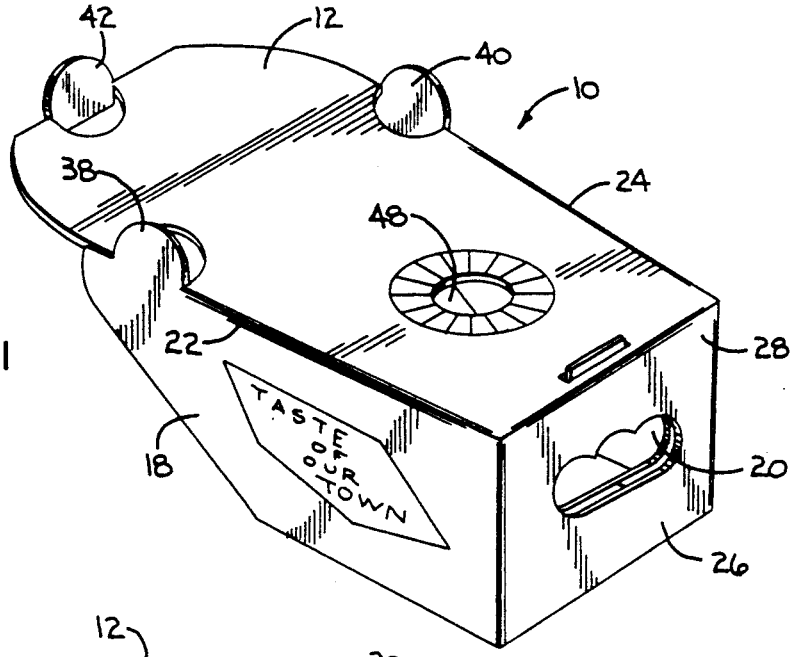
FIG. 1 is a perspective view of a plate and cup holder according to the present invention.
Figure 2:
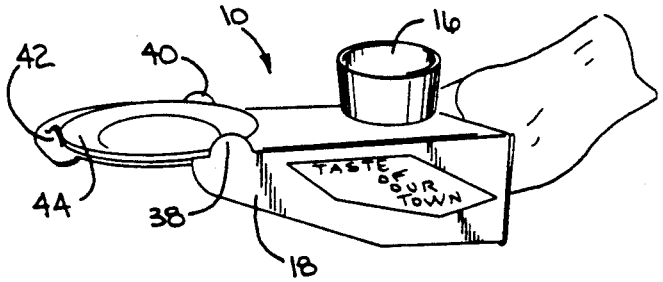
FIG. 2 is a perspective view illustrating the manner in which a plate and cup are supported on the holder shown in FIG. 1.

A plate and cup holder according to the present invention is shown in an assembled state in FIGS. 1 and 2 and is generally designated 10. Plate and cup holder 10 has a generally flat support panel 12 for supporting a plate 14 and a cup 16 when the holder is grasped by a single hand of an individual. The holder has pair of laterally spaced side panels 18 and 20 which depend from opposed side edges 22 and 24, respectively, on support surface 12. Advertising information or endorsements can be printed on either of the exterior faces of side panels 18 and 20. An end panel 26 depends from a rear edge 28 on support surface 12 and, together with the support surface, defines a gripping surface whereat the holder is grasped during use.

Figure 3:
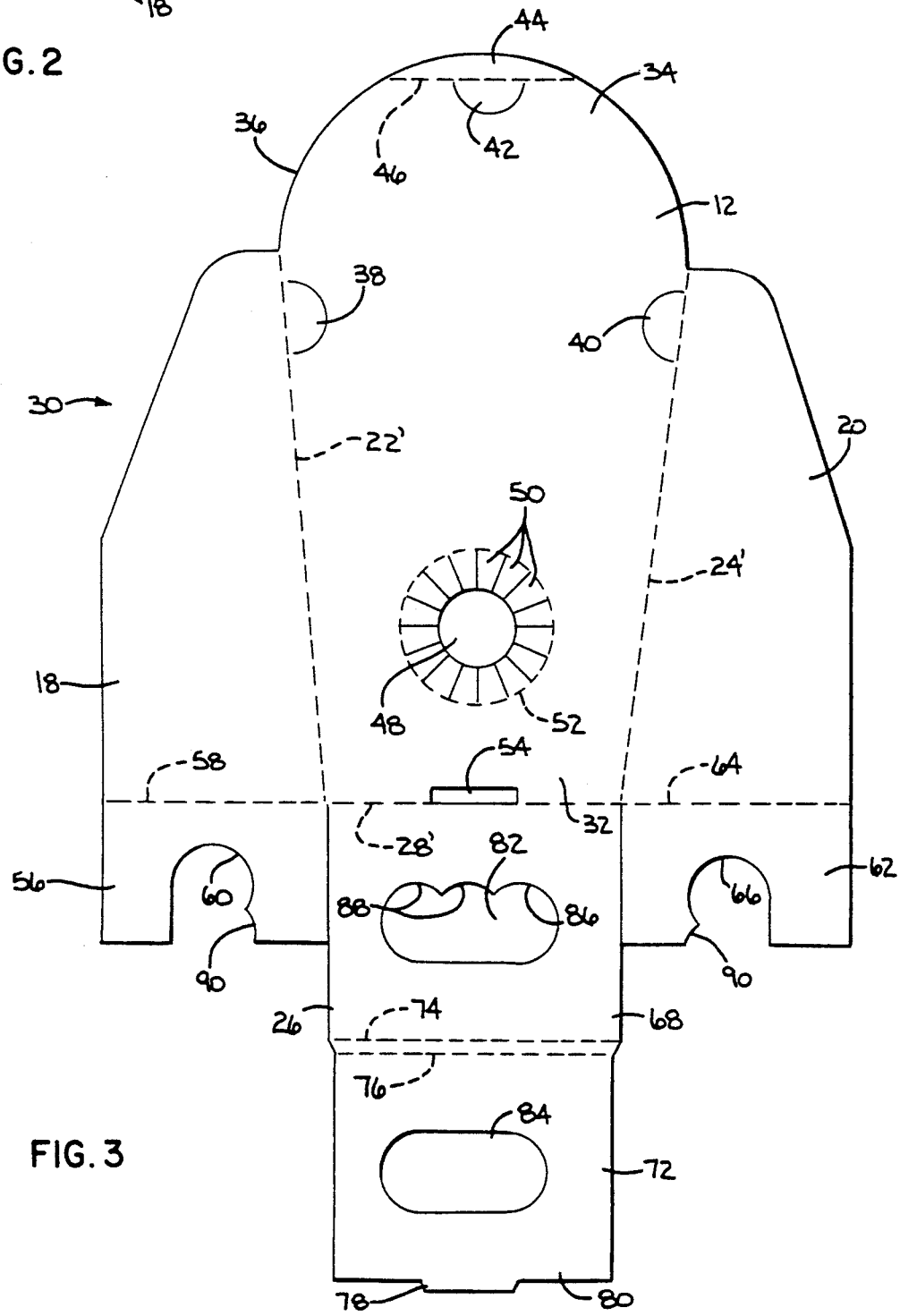
FIG. 3 is a plan view of a blank used to form the plate and cup holder.

A blank used to construct plate and cup holder 10 is depicted in FIG. 3 and is generally designated 30. Preferably, the blank is made from cardboard stock having sufficient rigidity to maintain its shape while supporting the intended food and beverages.

Blank 30 includes support panel 12, side panels 18 and 20, and end panel 26 each connected foldably relative to each other about lines that may be perforated, scored, or otherwise weakened so that folding of the panels relative to each other occurs in a predetermined fashion.

More specifically, side panel 18 is joined to support panel 12 along a fold line 22'. Side panel 20 is joined to support panel 12 along a fold line 24'. Fold lines 22' and 24' diverge from each other in a direction extending from a trailing end 32 of support panel 12 to a forward end 34 of the support panel, such that the width of support panel 12 (as defined by the lateral distance between the fold lines 22' and 24') is greater at the forward end of the support panel than at the trailing end, that is, such that the support panel 12 is rearwardly tapered. End panel 26 is joined to support panel 12 along a fold line 28' which extends transversely between fold lines 22' and 24' at trailing end 32 of the support panel.

Support panel 12 has a generally circular peripheral edge 36 at forward end 34 and which bounds a surface conforming at least in part to the shape of plate 14. A plurality of tabs 38, 40 and 42 are struck from support panel 12 and are foldable about associated fold lines into an upright position, as shown in FIGS. 1 and 2. More particularly, tab 38 is foldable about fold line 22' and tab 40 is foldable about fold line 24'. Tab 42 is integral with an arcuate lip 44 joined to forward end 34 of support panel 12 along a transverse fold line 46.

A generally circular opening 48 is provided in support panel 12 near trailing end 32. The opening is surrounded by a plurality of circumferentially spaced separable fingers 50 which are joined to support panel 12 along a circular fold line 52. The fingers radiate inwardly from fold line 52 a distance less than the diameter of circular fold line 52 to define opening 50 in the support panel. An opening 54 is provided in support panel 12 along fold line 28'.

Side panels 18 and 20 are substantially mirror images of each other.

Side panel 18 is joined to support panel 12 along fold line 22' between circular edge 36 and trailing fold line 28'. Side panel 18 has a tab 56 which extends rearwardly beyond fold line 28' when blank 30 is in the flattened state shown. Tab 56 is joined to side panel 18 along a fold line 58 and has a cutout 60.

Side panel 20 is joined to support panel 12 along fold line 24' between circular edge 36 and trailing fold line 28'. Side panel 20 has a tab 62 which extends rearwardly beyond fold line 28' when blank 30 is in the flattened state shown. Tab 62 is joined to side panel 20 along a fold line 64 and has a cutout 66. It should be noted that tabs 56 and 62 are not connected to end panel 26.

End panel 26 is a segmented panel and has articulated sections 68, 70, and 72 connected in series and extending from fold line 28'. That is, section 68 is joined to support panel 12 along fold line 28' and is foldably connected to section 70 along a fold line 74. Section 72 is similar in shape to section 68 and is joined to section 70 along a fold line 76. A tongue 78 projects from the free end 80 of end panel 26. Section 68 has a central opening 82 and section 72 has a central opening 84 for purposes to be described hereafter.

Figure 6:
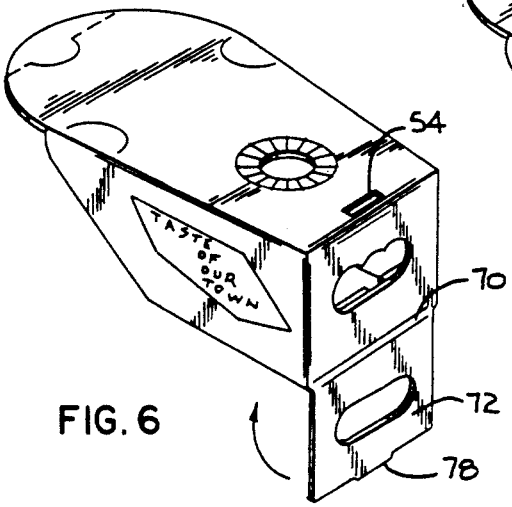

Assembly of plate and cup holder 10 will now be described with reference to FIGS. 4–6.

Figure 4:
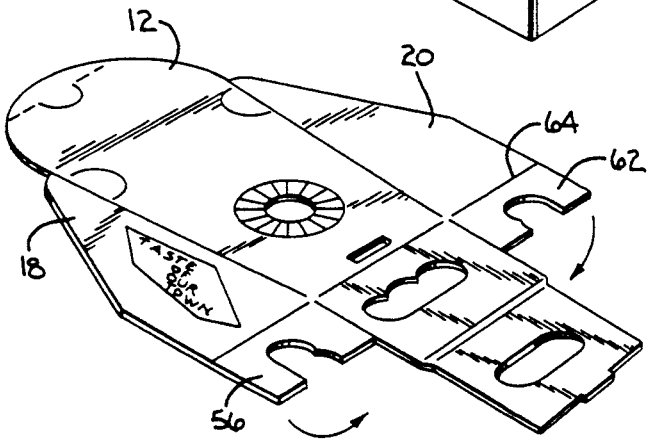
FIGS. 4–6 schematically illustrate of the manner in which the plate and cup holder is assembled.
Figure 5:
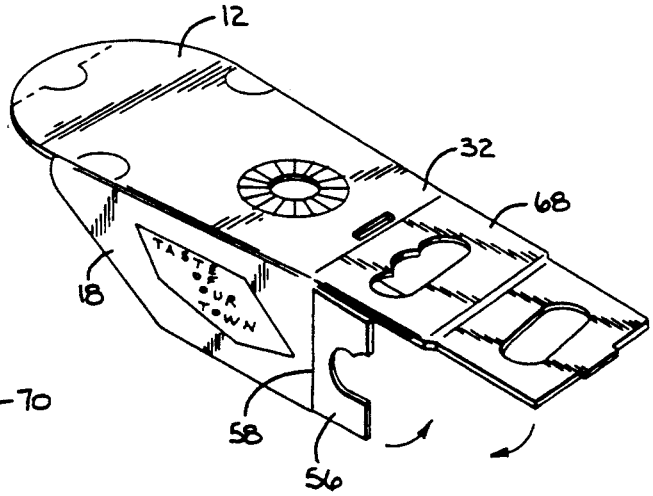

First, side panels 18 and 20 and corresponding tabs 56 and 62, respectively, are swung transversely of support panel 12 about fold lines 22' and 24', respectively, from the position shown FIG. 4 to the position shown in FIG. 5. Rotation of the side panels thus defines divergent side edges 22 and 24 on support panel 12.

Next, tab 56 is swung inwardly of side panel 18 about fold line 58 and beneath trailing end 32 of support panel 12. Similarly, tab 62 is swung inwardly of side panel 20 about fold line 64 and beneath trailing end 32 of support panel 12.

End panel 26 next is folded about fold line 28' to define edge 28 on support panel 12. Section 68 of the end panel first is folded downwardly and adjacent tabs 56 and 62. The end panel then is folded around the tabs whereby section 70 of the end panel engages the underside of the tabs. Section 72 is swung upwardly adjacent the tabs and tongue 78 is received in opening 54 to maintain the plate and cup holder in the assembled state. In other words, engagement of end panel 26 with tabs 56 and 62 secures the tabs beneath support panel 12 and thereby maintains side panels 18 and 20, respectively, in a transverse position with respect to the support panel.

Openings 82 and 84 advantageously are constructed such that the openings are mutually aligned when the plate and cup holder is assembled and thus define a handle on end panel 26 for receiving the fingers of an individual carrying the plate and cup holder (see also FIG. 2). Moreover, cutout 60 on tab 56 and cutout 66 on tab 66 cooperatively define an opening aligned with openings 82 and 84 when the plate and cup holder is assembled. In this regard, opening 82 has an edge 86 made up of a plurality of adjacent notches 88 for individually receiving the fingers of an individual. Cutouts 66 and 66 have notched inner edges, 90 and 92, respectively, to define notches aligned with notches 88 when the plate and cup holder is assembled.

To use plate and cup holder 12, tabs 38, 40 and 42 are folded about fold lines 22', 24', and 46, respectively, into an upright position for constraining movement of a plate on placed on support panel 12. A beverage container can be inserted into opening 48 and engaged with fingers 50 whereby resilient deformation of the fingers provides a uniform force around the exterior of the container for stabilizing and preventing overturning of the container. Engagement of end panel 26 with tabs 56 and 62 maintains the plate and cup holder in a sturdy interlocked condition whereby an individual may reliably hold and transport a plate and cup with a single hand.

Figure 7:
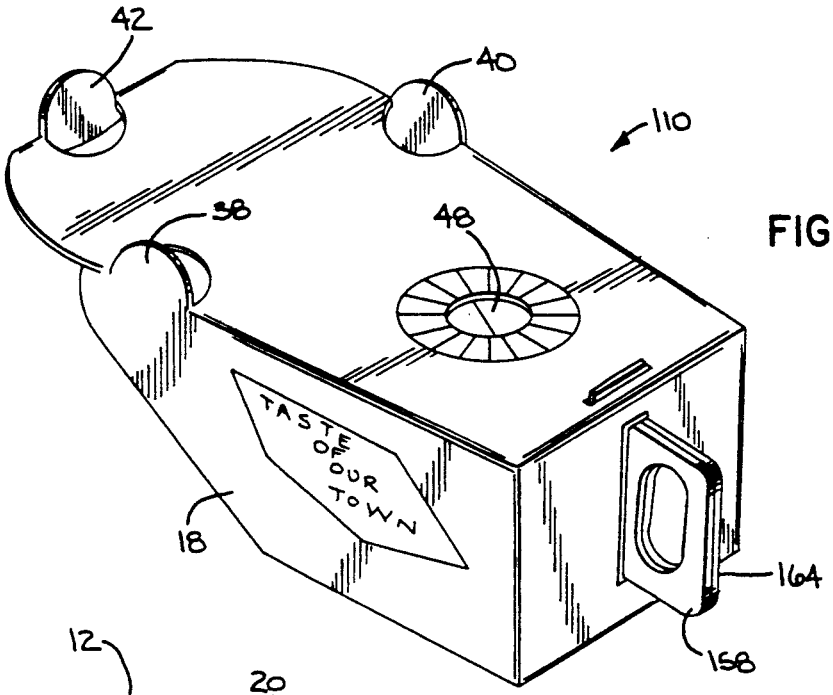
FIG. 7 is a perspective view of an alternative embodiment of a plate and cup holder.
Figure 8:
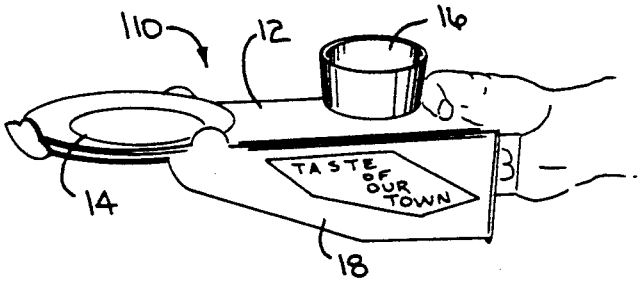
FIG. 8 is a perspective view illustrating the manner in which a plate and cup are supported on the holder shown in FIG. 7.

An alternative embodiment of a plate and cup holder is shown in an assembled state in FIGS. 7 and 8 and is generally designated 110. Plate and cup holder 110 is similar in many respects to the exemplary embodiment described above and will therefore be described herebelow with reference primarily to the appropriate distinctions. Like reference numerals have been used in FIGS. 7–12 to indicate components which are substantially identical to those previously discussed with respect to FIGS. 1–6.

Figure 9:
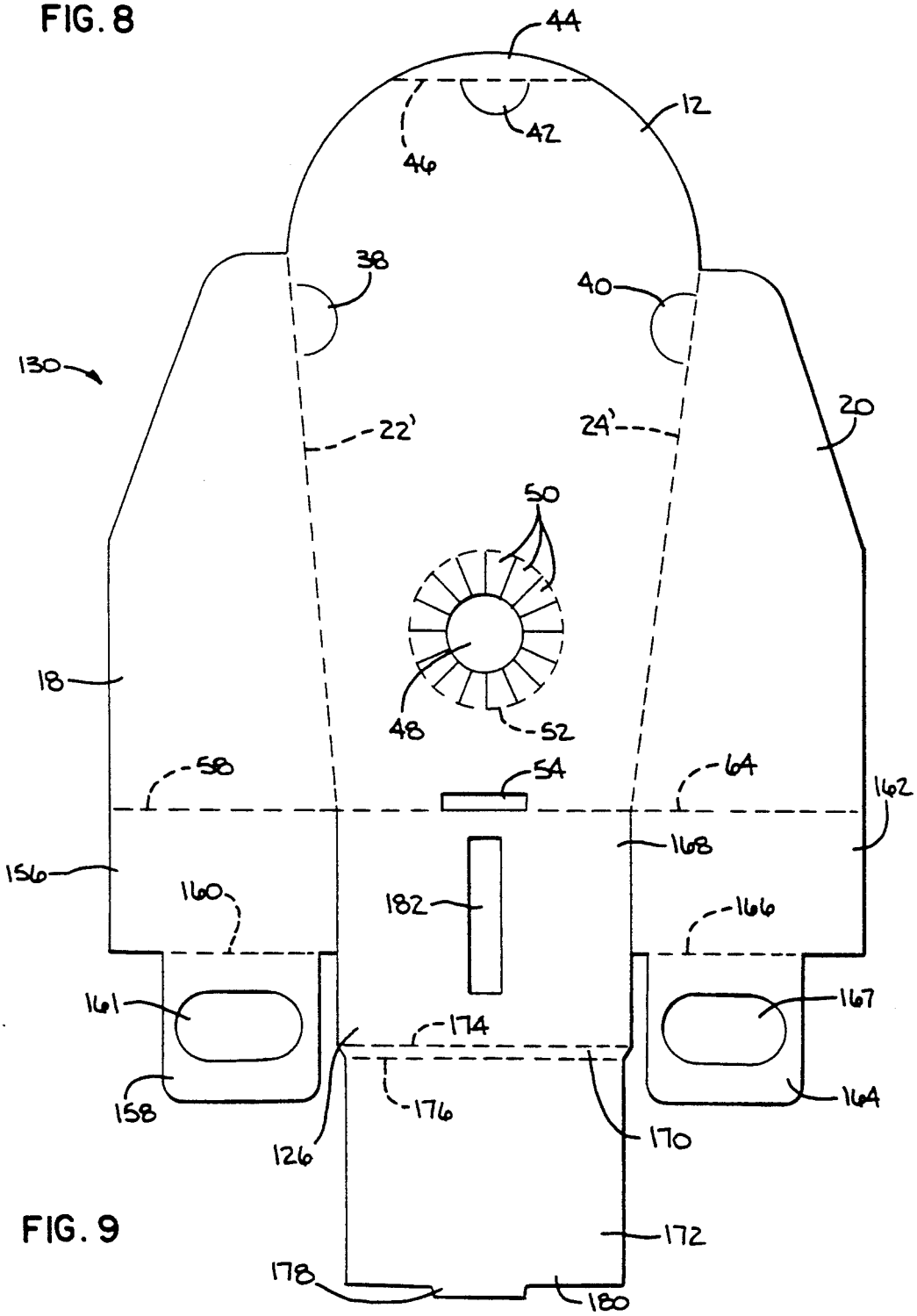
FIG. 9 is a plan view of a blank used to form the alternative plate and cup holder.

A blank used to construct plate and cup holder 110 is depicted in FIG. 9 and is generally designated 130. Blank 30 includes support panel 12, side panel 18 joined to support panel 12 along fold line 22', and side panel 20 joined to support panel 12 along fold line 24'. An end panel 126 is joined to support panel 12 along fold line 28'.

Side panel 18 has a tab 156 which extends rearwardly beyond fold line 28' when blank 130 is in the flattened state shown in FIG. 9. Tab 156 is joined to side panel 18 along fold line 58. An integral handle 158 extends from tab 156 and is joined thereto along a fold line 160. Handle 158 has a central opening 161.

Side panel 20 has a tab 162 which extends rearwardly beyond fold line 28' when blank 130 is in the flattened state shown in FIG. 9. Tab 162 is joined to side panel 20 along fold line 64. An integral handle 164 extends from tab 162 and is joined thereto along a fold line 166. Handle 164 has a central opening 167.

End panel 126 is a segmented panel and has articulated sections 168, 170, and 172 connected in series and extending from fold line 28'. That is, section 168 is joined to support panel 12 along fold line 28' and is foldably connected to section 170 along a fold line 174. Section 172 is similar in shape to section 168 and is joined to section 170 along a fold line 176. A tongue 178 projects from the free end 180 of end panel 126. Section 168 has an elongated central opening 182 for purposes to be described hereafter.

Figure 10:
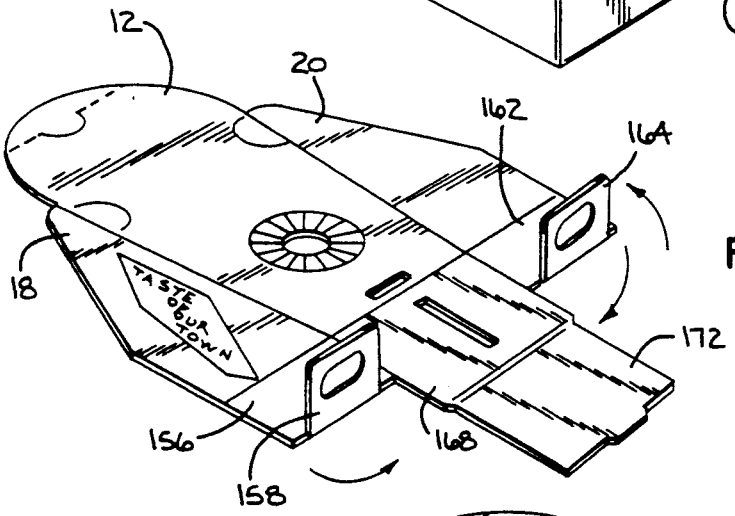
FIGS. 10–12 schematically illustrate the manner in which the alternative plate and cup holder is assembled.
Figure 12:
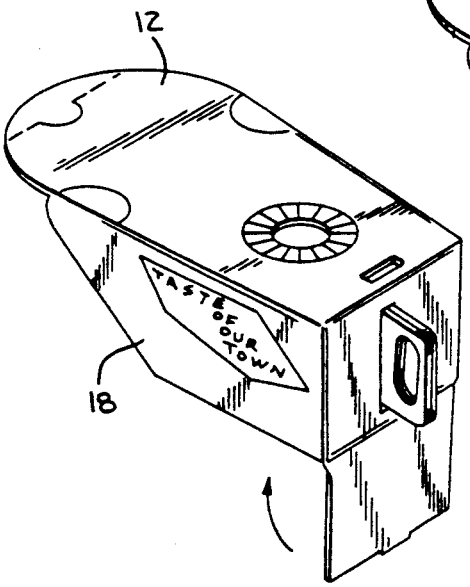
Figure 11:
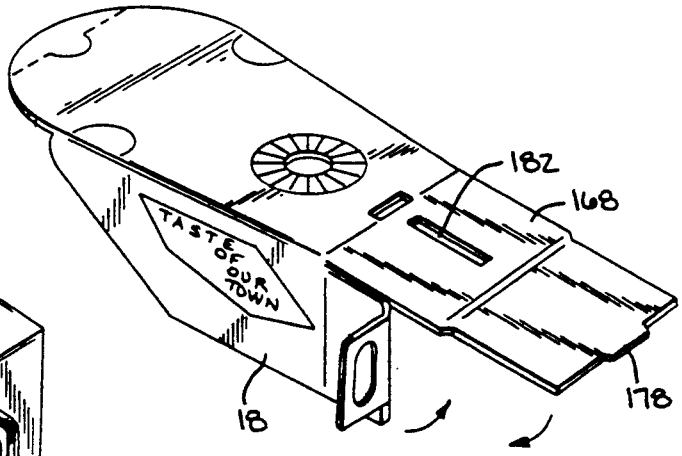

Assembly of plate and cup holder 110 can be understood with reference to FIGS. 10–12.

First, handles 158 and 164 are folded transversely of tabs 156 and 168, respectively. Then, side panels 18 and 20 and the corresponding tabs 156 and 162, respectively, are swung transversely of support panel 12 about fold lines 22' and 24', respectively, from the position shown FIG. 10 to the position shown in FIG. 11.

Next, tab 156 is swung inwardly of side panel 18 about fold line 58 and beneath trailing end 32 of support panel 12. Similarly, tab 162 is swung inwardly of side panel 20 about fold line 64 and beneath trailing end 32 of support panel 12 to abut handles 158 and 164 and place openings 161 and 167 in mutual alignment.

End panel 126 next is folded about fold line 28' such that adjacent handles 158 and 164 are received in elongated opening 182 on section 168. The end panel then is folded around the tabs whereby section 170 of the end panel engages the underside of the tabs. Section 172 is swung upwardly adjacent the tabs and tongue 178 is received in opening 54 to maintain the plate and cup holder in the assembled state with the transverse handles 158 and 164 securely locked in place.

Additional forms of the invention are shown in FIGS. 13–16.

Figure 13:
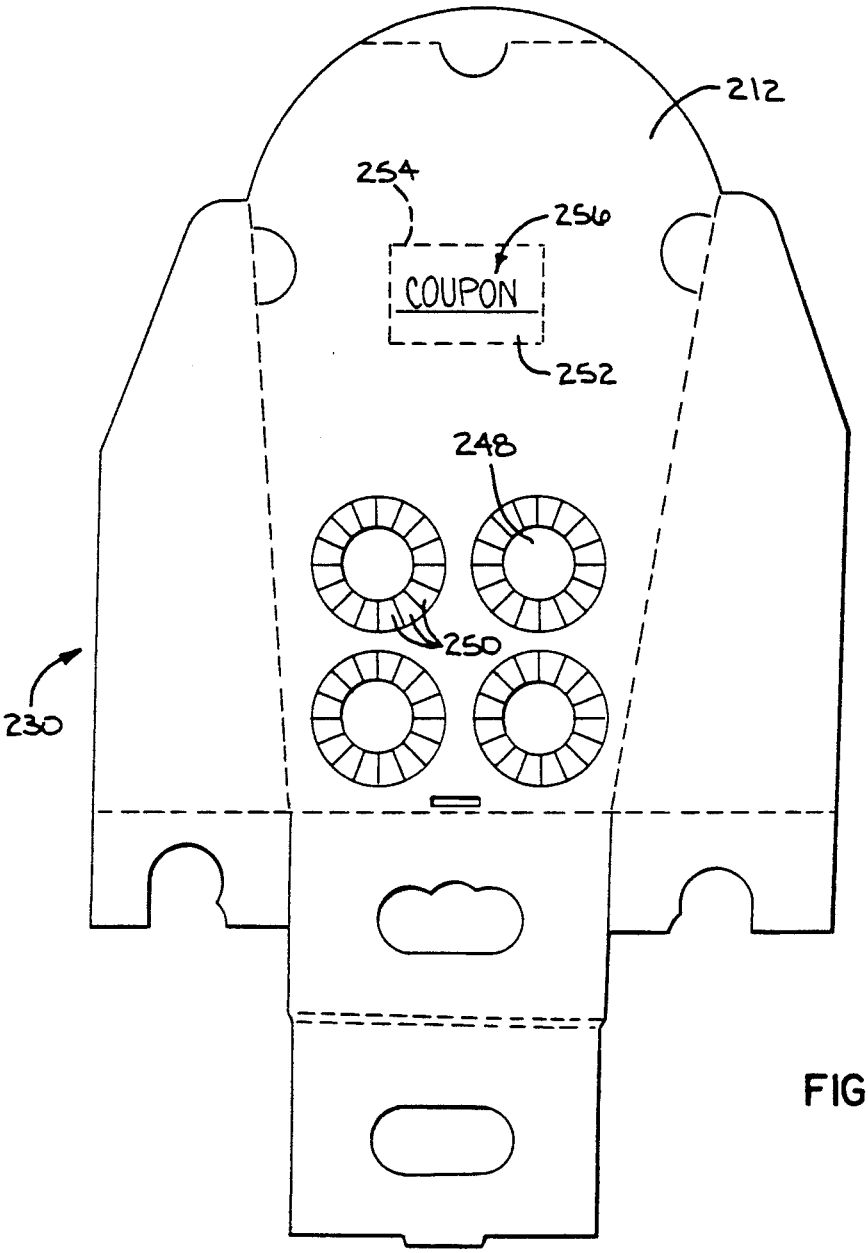
FIG. 13 is a plan view of a blank used to form an additional embodiment of the plate and cup holder.
Figure 14:
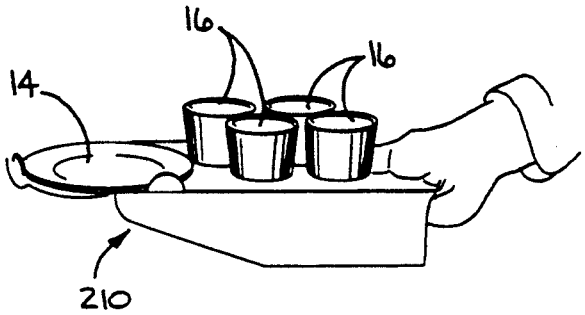
FIG. 14 is a perspective view of the assembled plate and cup holder of FIG. 13.

A blank 230 is depicted in FIG. 13 and is used to construct the holder 210 illustrated in FIG. 14 for supporting a plate 14 and a plurality of cups 16. Blank 230 has four generally circular openings 248 formed in a support panel 212 for receiving the cups 16. The openings have substantially the same construction as the openings 48 discussed above with respect to FIGS. 3 and 9 and are each surrounded by a plurality of circumferentially spaced separable fingers 50 for securely embracing cups 16 received in the corresponding openings. Support panel 212 is slightly wider and longer than support panel 12 shown in FIGS. 3 and 9 so as to accommodate additional cups 16 and plate 14.

A detachable coupon 252 is provided on support panel 212 forwardly of cup openings 248. Coupon 252 is made of the same material as support panel 212 and is struck therefrom by means of a perforated score line 254. The coupon carries a promotional message or offer 256 and can be removed from support panel 212 by a person using plate and cup holder 210 prior to discarding of the holder and then can be redeemed for appropriate value. Of course, although detachable coupon 252 is described in particular with respect to plate and cup holder 210, the invention envisions that a detachable coupon can be provided on any of the plate and cup holders disclosed herein.

Figure 15:
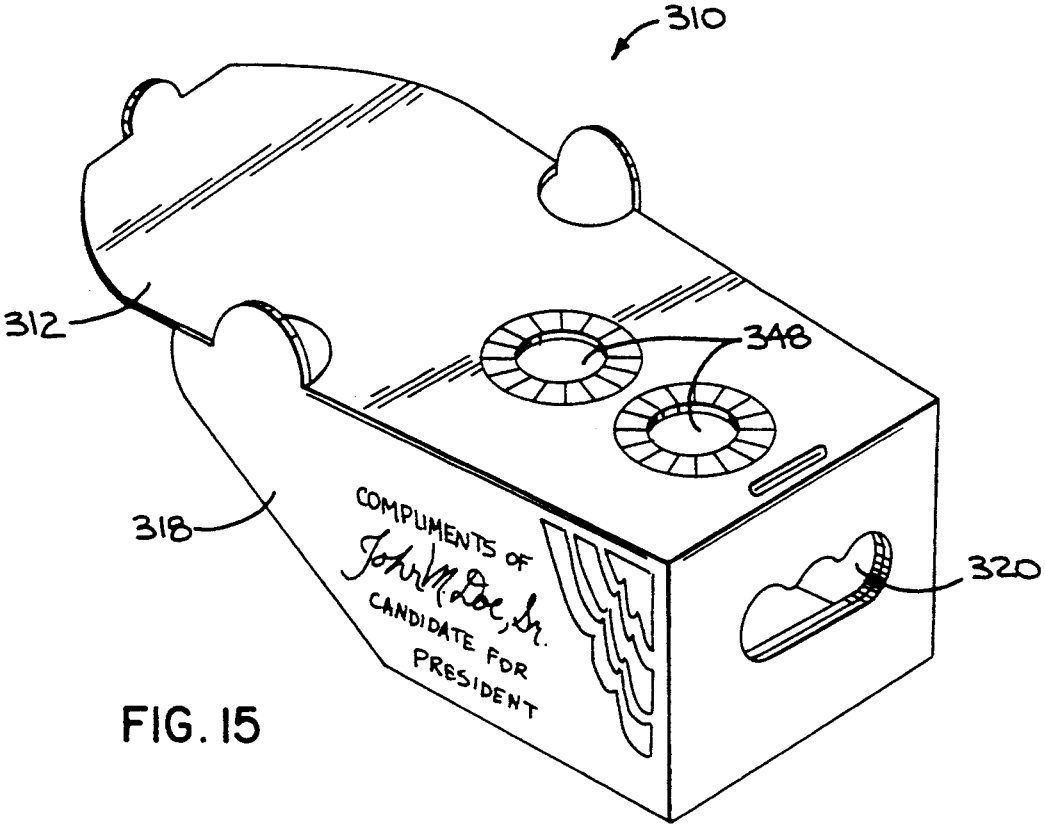
FIG. 15 is a perspective view of another embodiment of the plate and cup holder.

FIG. 15 illustrates a plate and cup holder 310 having a support panel 312 and mutually opposed parallel side panels 318 and 320, with the exterior face of side panel 318 shown. Support panel 312 has a pair of aligned openings 348 such that plate and cup holder 310 is adapted to support two cups 16. Support panel 212 is slightly longer than support panel 12 shown in FIGS. 3 and 9 so as to accommodate the additional length of two cups 16 and plate 14. Advertising information or other endorsements can be printed on either of the exterior faces of side panels 318 and 320.

Figure 16:
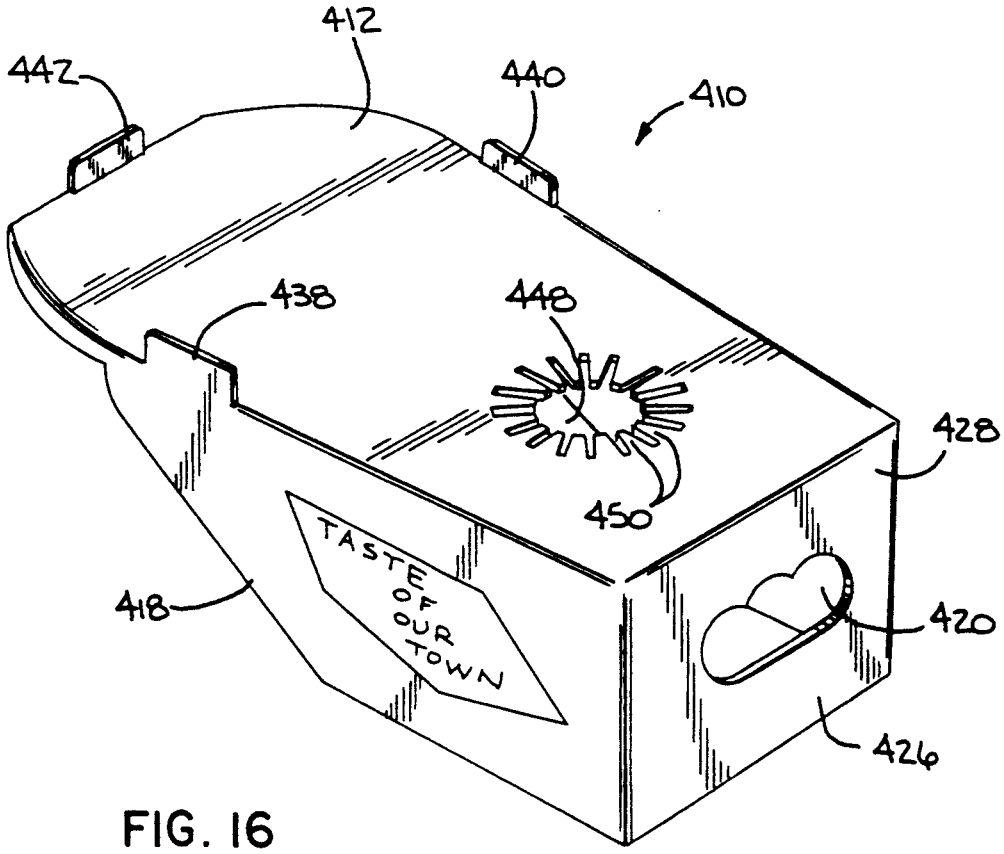
FIG. 16 is a perspective view of a further embodiment of the plate and cup holder.

Although each of the previous embodiments of a plate and cup holder is made of cardboard or other foldable stock, the invention also foresees an integrally molded plastic plate and cup holder 410, illustrated in FIG. 16. Although a plastic plate and cup holder may take the form of any of the previously described embodiments of holders 10, 110, 210, and 310, the follow description relates in particular to a plate and cup holder generally similar to plate and cup holder 10.

As shown in FIG. 16, plate and cup holder 410 has a generally flat support panel 412 for supporting a plate 14 and a cup 16. The holder has pair of laterally spaced sides 418 and 420 and an end 426 depends from a rear edge 428 on support surface 412. A plurality of tabs 438, 440 and 442 are molded integrally with support panel 412 for constraining movement of a plate 14 supported on the holder. A circular opening 448 in support panel 412 is surrounded by a plurality of separable resilient fingers 450 for stabilizing a cup 16 received in the opening.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. A plate and cup holder comprising a plurality of panels foldably attached relative to each other and converted from a flattened state into an assembled state, the plate and cup holder comprising:

a support panel having a first end with an opening for receiving a cup and a second end for supporting a plate, the support panel having a pair of laterally spaced side edges extending between the first end and the second end;

a first side panel attached to the support panel along one of the side edges and a second side panel attached to the other of said side edges, the first side panel and the second side panel being swung transversely of the support panel when the holder is in the assembled state;

a tab on each of said side panels folded inwardly of a respective side panel and beneath said first end of the support panel when the holder is in the assembled state; and an end panel foldably attached to the support panel at said first end and engaged with said tabs to maintain the holder in the assembled state.

2. The plate and cup holder of claim 1 in which the second end of the support panel has a plurality of upright tabs for constraining movement of a plate on the support panel.

3. The plate and cup holder of claim 1 in which the opening in the first end of the support panel has deformable finger means for closely embracing and constraining movement of a cup received in the opening.

4. The plate and cup holder of claim 1 in which the support panel has a plurality of additional openings for receiving cups.

5. The plate and cup holder of claim 1 in which the side edges are mutually divergent from the first end of the support panel toward the second end of the support panel whereby the lateral distance between the side edges adjacent the second end of the support panel is greater than the lateral distance between the side edges adjacent the first end of the support panel.

6. The plate and cup holder of claim 1 in which the second end of the support panel has an arcuate edge to define a support surface conforming at least in part with a circular plate supported thereon.

7. The plate and cup holder of claim 1, including means on the end panel for allowing an individual to grasp the holder with a single hand.

8. The plate and cup holder of claim 7 in which the means for grasping the holder comprises an opening on said end panel for receiving the fingers of an individual carrying the holder.

9. The plate and cup holder of claim 8 in which the opening in the end panel has an edge comprising a number of adjacent notches for individually receiving the fingers of an individual grasping the holder.

10. The plate and cup holder of claim 7 in which the means for grasping the holder comprises a handle extending transversely from the end panel when the holder is in the assembled state.

11. A blank having a plurality of panels foldably attached relative to each other and convertible from a flattened state into a plate and cup holder comprising:

a support panel having a first end with an opening for receiving a cup and a second end for supporting a plate, the support panel having a pair of laterally spaced side edges extending between the first end and the second end;

a first side panel attached to the support panel along one of the side edges and a second side panel attached to the other of said side edges, the first side panel and the second side panel being swung transversely of the support panel when the blank is converted to a plate and cup holder;

a support tab foldably attached at an end of each of said side panels adjacent said first end of the support panel; and an end panel foldably attached to the support panel at said first end.

12. The blank of claim 11, including means on the end panel for grasping a plate and cup holder converted from said blank by a single hand of an individual carrying the holder.

13. The blank of claim 11 in which the end panel has a first end attached foldably relative to the support panel and a second end, the support panel having a slot positioned to receive the second end of the end panel to maintain engagement of the end panel with the tabs when the blank is converted into a plate and cup holder.

14. The blank of claim 12 in which the means for grasping the plate and cup holder comprises an opening in said end panel for receiving the fingers of an individual, the tabs having cutouts aligned with said opening when the blank is converted into a plate and cup holder.

15. The blank of claim 12 including a detachable coupon for carrying a promotional message.

16. The blank of claim 15 in which the coupon is struck from the support panel.

17. A plate and cup holder comprising:

a platform for supporting a plate, the platform having a plurality of upright tabs for constraining movement of a plate on the platform;

means on the platform for supporting and constraining movement of a cup; and a handle for allowing an individual to grasp the holder with a single hand and carry the plate and cup.

18. The plate and cup holder of claim 17 in which the platform and the handle are integrally molded plastic.

19. The plate and cup holder of claim 17 further comprising a plurality of panels attached foldably relative to each other.

20. The plate and cup holder of claim 17 in which the platform has a first end and a second end and a pair of laterally spaced side edges extending between the first end and the second end, the means for constraining movement of a cup comprising an opening in the platform at said second end for receiving the cup.

21. The plate and cup holder of claim 20 in which the lateral distance between the side edges defines a width of the platform, and wherein the side edges diverge from the first end of the platform whereby the width of the second end of the platform is greater than the width of the first end of the platform.

22. The plate and cup holder of claim 20 in which the second end of the platform has an arcuate edge to define a support surface conforming at least in part with a circular plate supported thereon.

* * * * *